US006096132A

United States Patent [19]

Kaiba et al.

[11] Patent Number: 6,096,132

[45] Date of Patent: Aug. 1, 2000

[54] AUTOMATIC PAINTING DEVICE

[75] Inventors: Tadashi Kaiba; Syusei Murai, both of Tokyo, Japan

[73] Assignee: L.A.C. Corporation, Tokyo, Japan

[21] Appl. No.: 09/112,270

[22] Filed: Jul. 8, 1998

[51] Int. Cl.[7] ..... B05C 11/00

[52] U.S. Cl. ..... 118/680; 118/712; 118/679; 118/629

[58] Field of Search ..... 118/712, 671, 118/323, 679, 676, 684, 680, 668, 681, 713, 621, 629; 901/46

[56] References Cited

U.S. PATENT DOCUMENTS

| | | | |
|---|---|---|---|
| 4,357,900 | 11/1982 | Buschor | 118/681 |
| 4,743,819 | 5/1988 | Hashizume | 318/368 |
| 4,864,966 | 9/1989 | Anderson et al. | 118/668 |
| 5,240,745 | 8/1993 | Yamamoto et al. | 427/421 |
| 5,814,375 | 9/1998 | Hissen | 427/421 |

FOREIGN PATENT DOCUMENTS

| | | |
|---|---|---|
| 0 317 219 | 5/1989 | European Pat. Off. . |
| 0 333 609 | 9/1989 | European Pat. Off. . |
| 42 09 279 | 9/1993 | Germany . |

OTHER PUBLICATIONS

Patent Abstracts of Japan; JP 09–206641, dated Aug. 12, 1997 English Language Abstract (1 page).

Patent Abstracts of Japan; JP 08–057373, dated Mar. 5, 1996 English Language Abstract (1 page).

Patent Abstracts of Japan; JP 07–265755, dated Oct. 17, 1995 English Language Abstract (1 page).

*Primary Examiner*—Richard Crispino
*Assistant Examiner*—George R Koch, III
*Attorney, Agent, or Firm*—Flynn, Thiel, Boutell & Tanis, P.C.

[57] ABSTRACT

An automatic painting device wherein control for driving spray gun heads in a Z axis direction is executed correctly with respect to a surface to be painted having a curved shape so that painting can be effected while keeping a constant interval between the plurality of spray gun heads and the surface to be painted. The automatic painting device can include a spray gun head unit holding a plurality of spray gun heads, an X axis direction driving mechanism for driving the spray gun head unit in a horizontal X axis direction, and a Y axis direction driving mechanism for driving the spray gun head unit in a Y axis direction perpendicular thereto, and in which different paints are ejected by the plurality of spray gun heads. The different spray gun heads are held by the spray gun head unit movably in a Z axis direction perpendicular to the x axis direction and the Y axis direction, independently from each other. The automatic painting device includes Z axis direction driving motors, which drive the spray gun heads in the Z axis direction, independently from each other on the basis of measured data and set data relating to a distance between a relevant spray gun head and an object to be painted. In this way the distance between the different spray gun heads and the surface to be painted constant can be kept constant, which improves remarkably the image quality of painting.

16 Claims, 12 Drawing Sheets

AUTOMATIC PAINTING DEVICE

FIELD OF THE INVENTION

The present invention relates to an automatic painting device capable of painting a desired colored image on a surface to be painted by driving three-dimensionally a plurality of air pressure ejection type color ink spray gun heads and in particular to an improvement for making clear painting possible with precise color tone, even if the surface to be painted is a complicated curved shape such as a body of an automobile.

DESCRIPTION OF THE PRIOR ART

Recently a printer of ink jet type has been used as a printing device for a computer. This ink jet printer reproduces color tone for pixels by ejecting inks of four colors, which are the three primary colors of red, blue and yellow, and black from each of nozzles, superposing them on a print, and responding to the color tone of each of the pixels stored in a memory device in a computer. Then it is possible to paint image data on a print sheet of paper by driving the nozzles in right and left directions and the print sheet in a perpendicular direction.

In a printer, material to be painted is restricted to a paper-like matter. If it is possible to paint image data by an ink spray gun head system directly, e.g. on a body of an automobile, etc., even complicated designs can be reproduced industrially by mass production.

FIGS. 12 to 14 show an example of a prior art automatic painting device.

In FIG. 12, reference numeral 1 is a CPU for processing image data; 2 is a mechanism for controlling drive of the spray gun heads and ejected amounts of color inks; 3 is a CPU for controlling the mechanism; 4 is a memory; 5 is a key board for manually operating the mechanism; 6 is an LCD display device displaying operation by means of the key board; 7, 8, 9 and 10 are an NTSC input terminal, an image scanner input terminal, a mouse input terminal and a first floppy disk input terminal, respectively.

Further, 11 is an A/D converter; 12 is a memory; 13 and 14 are input/output sections; 15 is a frame memory; 16 is a D/A converter; 17 is a monitor output terminal; and 18 is a second floppy disk output terminal.

Still further the mechanism 2 consists of an X and a Y axis driving mechanism 20 and 21 for driving spray gun heads in an X and a Y axis direction with respect to a wall surface and a Z axis driving mechanism 22 for controlling a distance from the wall surface so as to keep it at a predetermined value as well as color ink ejection amount controlling mechanisms 23 for the spray gun heads, etc.

This ink jet printer is so constructed that output signals from a video deck VD, a video camera VM, an image scanner IM, a serial mouse SM and a first floppy disk $FD_1$ are inputted to the input terminals 7 to 10, respectively, and that these output signals, i.e. image data, are input to the CPU 1 to be subjected thereby to image processing such as addition, etc. of the image data so that signals necessary for painting are given to the other CPU 3 for controlling the mechanism through the input/output section 14.

Further the CPU 1 for image processing stores painting signals obtained by editing the image data taken-in from the different input terminals in a second floppy disk $FD_2$ through the output terminal 18 so that they can be utilized if necessary. The painting signals are output to the output terminal 17 through the frame memory 15 and the D/A converter 16 so that they can be monitored by a color monitor CM.

The different mechanisms for driving the spray gun heads are disposed on a frame 30 as indicated in FIG. 15.

The frame 30 consists of upper, low, left and right frame units 31 to 34 as well as left and right leg members 35 and 36 assembled together by means of screws, as indicated in FIG. 16, and is fixed parallelly to a wall surface 37 with a predetermined distance at a job site, as indicated in FIG. 17.

The X and the Y axis driving mechanisms 20 and 21 are disposed so as to be opposite to the frame 30, as indicated in FIG. 18.

The X axis driving mechanism 20 consists e.g. of a fixed portion 40 mounted on the frame 30 and a driving portion 40 moving along the fixed portion 40 as indicated in FIG. 19. The fixed portion 40 comprises a rail 42 and a rack gear 43 and on the other hand the driving portion 41 is provided with a linear roller 44, a pignon gear 45, a reduction gear 46, a motor 47, a rotary encoder 48 and a Z axis driving mechanism supporter 49. The linear roller 44 is engaged with the rail 42 slidably along it and the pignon gear 45 is in gear with the rack gear 43.

Responding to an X axis control signal from the CPU 3, the motor 47 drives the pignon gear 45 through the reduction gear 46 and in this way it can move the Z axis driving mechanism supporter 49 in the X axis direction along the rail 42 by a predetermined distance at a time.

As indicated in FIG. 18, the Y axis driving mechanism 21 consists of Y axis driving units 21*a* and 21*b*, each of which has an approximately same construction as the X axis driving mechanism. These units are disposed on the left and right frame units 33 and 34 of the frame 30 to support the two extremities of the X axis driving mechanism 20. In this way, responding to a Y axis control signal from the CPU 3, it can move the X axis driving mechanism 20 in a Y axis direction (up- and downward).

As indicated in FIG. 23, the Z axis driving mechanism 22 consists e.g. of a movable controller 221, a photo sensor 222, a four-spray gun-head unit 223, a spray gun head supporting plate 224, etc. disposed on the supporter 49 of the X axis driving mechanism 20. The movable controller 221 comprises a roller 225 and a linear pulse motor 226 for position control in a Z axis direction and responding to a signal from the photo sensor 222 mounted on an extremity lower portion of the supporting plate 224, it controls the spray gun head unit 223 according to instruction pulses from the CPU 3 so that the distance L of the spray gun heads 223*a* to 223*d* from a wall surface 227 is kept constant.

In the automatic painting device, when image signals corresponding to an original image to be printed are inputted to either one of the input terminals 7 to 10, they are sent to the CPU 1 to be processed thereby so that signals necessary for a print are given to the CPU 3 for controlling the mechanism. Responding to the signals, the CPU 3 sends driving control signals to the different mechanisms 20, 21, 22 and 23 to drive the spray gun head unit 223 in the X and the Y axis direction while keeping the distance thereof from the wall surface constant and to eject inks from the spray gun heads for each pixel of the image in order to print an enlarged color image and move the different mechanisms to following pixels successively.

Concerning movement in the Z axis direction, the distance from the wall surface to be painted is detected by the photo sensor 222. By signals thus detected the linear pulse motor is driven to move the supporter 49 and the spray gun heads 223*a* to 223*d* are controlled so that the distance thereof from the wall surface is kept constant. By using this automatic painting device, since it is possible to paint the image data in an enlarged scale on the wall surface to be painted by driving the spray gun head units 223 in the X axis and the Y axis direction and to keep the distance of the spray gun heads from the wall surface constant by driving the supporter 49 in the Z axis direction, even if the wall surface to be painted has a curved shape, it is possible to obtain a clear print.

By the automatic painting device described above, a pixel having a predetermined color tone can be printed by superposing inks ejected by the four spray gun heads 223*a* to 223*d* at one point. However, in cases where the wall surface to be painted has a complicated uneven curved shape, positions of inks ejected by the four spray gun heads are subtly shifted from each other. Therefore there was a fear that the color tone at a point differed from that at other points or it was unclear.

For example, in some cases the case positions where the four spray gun heads 223*a* to 223*d* are mounted, are shifted slightly from each other in the left and right direction as indicated in FIG. 20. If a wall surface 600 to be painted has a shape including an inclined part 601, distances of the spray gun heads 223*a* to 223*d* from the wall surface to be painted differ from each other. That is, as indicated in FIGS. 21 and 22, in a case where a point P is painted by the spray gun head 223*a* located at the left extremity, the distance between the wall surface 600 to be painted and the photo sensor 222 is L. However, when the succeeding spray gun head 223*b* paints the point P, the spray gun head unit 223 is shifted in the X axis direction in order that the nozzle hole of the spray gun head 223*b* is placed at a position opposite to the point P. As the result, the photo sensor 222 is opposite to an inclined part 601 and therefore the distance between the wall surface to be painted 600 and the photo sensor 222 is L' greater than L. Therefore the supporter 49 is driven to be advanced in order to make the value detected by the photo sensor 222 equal to that obtained for the spray gun head 223*a*. As the result, the distance between the spray gun head 223*b* and the wall surface to be painted 600 becomes smaller, which varies the painted area, giving rise to inconveniences that the color tone differs from that of surrounding parts and that clarity lowers.

In order to remove the inconveniences, it is necessary that each of the spray gun heads 223*a* to 223*d* is held movably in the Z axis direction and that painting can be effected while driving the different spray gun heads so that the distance (interval) in the Z axis direction between the wall surface to be painted and them is kept constant. For this reason, it is conceivable to adopt a method, wherein a sensor detecting the displacement distance in the Z axis direction is disposed on the spray gun head unit and drive of the unit is controlled by using a detection signal of the sensor.

However, in reality, this method cannot be applied in practice. This is because the spray gun head unit is driven in the X and the Y axis direction with a constant speed and in case where the wall surface to be painted has a curved shape such as a body of an automobile, if following control in the Z axis direction is executed by using this detection signal of the sensor, since there is a limit in response speed of this control, the following control of the displacement in the Z axis direction cannot be effected correctly. Further, in case where there is a difference in level in the Z axis direction, etc., there is a fear that the spray gun heads are damaged.

SUMMARY OF THE INVENTION

In order to solve such a problem, an object of the present invention is to provide a device capable of painting automatically a desired colored image directly on a surface to be painted having a curved shape such as a body of an automobile, which makes it possible to control displacement of spray gun heads in a Z axis direction by following variations of the surface to be painted, without using any displacement distance sensor in the Z axis direction.

In order to achieve the above object, an automatic painting device according to the present invention, comprising holding or supporting means, which holds or supports a plurality of air pressure ejection type color ink spray gun heads movably in X, Y and Z axis directions; X and Y axis direction driving means, which drive the holding means in the X and Y axis directions; Z axis direction driving means, which drive the spray gun heads independently from each other in the Z axis direction; control means, which controls drive of the spray gun heads and ejected amounts of color inks, depending on a position and a color tone of each pixel of an original image, is characterized in that it comprises further measuring means, which measures displacement distances in the Z axis direction from the spray gun heads to a plurality of coordinate points (Xi, Yi) in a desired region on a surface to be painted to output measured data; setting means, which sets desired painting speeds and desired painting distances in the Z axis direction from the surface to be painted to output set data; and input means, which compares the measured data coming from the measuring means with Z axis direction driving capacity data and inputs them together with the set data to the control means, when it is judged that they can be driven, in order that the control means controls drive of the spray gun heads on the basis of the-data.

In the present invention, the measuring means may include a body measuring instrument, which measures the Z axis direction displacement distances from the spray gun heads to a coordinate point by bringing a marker into contact with the coordinate point, and a measuring plate having a shape analogous to the spray gun heads may be mounted on an extremity of the marker.

Further, in the present invention, the measuring means may set an interval between coordinate points in the X axis direction, depending on the painting speeds and distances, over which the spray gun heads can be moved in the Z axis direction, corresponding to the coordinate points, to effect measurements for obtaining data on the coordinate points.

An automatic painting device according to the present invention comprises a plurality of, e.g. four, well-known air pressure ejection type color ink spray gun heads of four colors; a unit holding these spray gun heads movably in X, Y and Z axis directions; X and Y axis direction driving means, which drives the unit; Z axis direction driving means, which drives the spray gun heads independently from each other in the Z axis direction; control means comprising a computer, which controls drive of the spray gun heads and ejected amounts of color inks, depending on the position and the color tone of each pixel of an original image, etc.

Well-known means can be adopted for the X, Y and Z axis direction driving means, for drive by engagement of a rack with a pignon; drive by a cylinder device, drive by using a stepping motor, etc.

The device according to the present invention is characterized in that data (Xi, Yi, Zi) of a plurality of coordinate points in a desired region on a surface to be painted are measured without using any Z axis direction displacement distance sensors and at the same time desired painting speeds (print speeds) and desired painting distances (print surface distances) in the Z axis direction from the surface to be painted are set. Since the spray gun heads are damaged, if the measured data are used as they are, i.e. if measured data (large difference in level, etc.) exceeding driving capacity in the Z axis direction are input and the spray gun head unit is driven according thereto, the measured data are compared previously with driving capacity data and used, only if it is judged that the spray gun head unit can be driven according to these data. At this time, the control means controls drive of the spray gun heads on the basis of these measured data (body data) and set data.

For example, data of coordinate points consist of data (Xi, Yi) obtained by setting orthogonal coordinate points in the X and Y axis directions and data (Zi) obtained by measuring Z axis direction distances from these coordinate points. These data are given previously to a computer serving as the control means.

In this case, since there can be differences in the Z axis direction distance, over which the spray gun head unit can be moved, when it is displaced transversally (X axis direction displacement distance), at setting the coordinate points, it is preferable that the interval in the X axis direction between coordinate points is set, depending on the set painting speed and the Z axis direction distance, over which the spray gun head unit can be moved, to effect measurements of the data of the coordinate points.

When the body data (Z axis direction displacement distance Zi) measured as described above as well as the set painting speed and distance from the surface to be painted are given to the computer, at first control signals in the X and the Y axis direction necessary for painting, based on the data (Xi, Yi) of the original image, are transmitted to the X, Y axis direction driving means and the spray gun head unit is moved to a predetermined position so that one of the spray gun heads is placed at a position opposite to a point on the surface to be painted. Then, since the Z axis direction displacement distance to the point to be painted is given as the measured data, the Z axis direction driving means is driven so that it is at that distance and thereafter a predetermined amount of color ink is ejected from the spray gun head so as to have a concentration obtained on the basis of the image data, to paint the image. This control process is effected for all the spray gun heads and color inks from the different spray gun heads which are superposed on each other at the point to be painted to paint it with a predetermined color tone. The point on the surface to be painted corresponding to each pixel in the original image is moved one after another and the same control process is effected for all the points to be painted to terminate the painting.

As described above, by using the automatic painting device, the Z axis direction displacement distance between the surface to be painted and the different spray gun heads is given previously by the measured data and they are driven independently from each other on the basis thereof. Consequently, even if the surface to be painted has a curved shape such as a body of an automobile, it is possible to keep easily the distance between each of the spray gun heads and the surface to be painted constant. Since image quality is remarkably improved and in addition the Z axis direction displacement distance can be correctly controlled by using body data previously measured and given without using any sensor, can be completely prevented damage to the spray gun heads.

DESCRIPTION OF THE PREFERRED EMBODIMENTS

Hereinbelow the present invention will be explained more concretely by using an embodiment. Points where the present invention differs from the prior art automatic painting device consist in the construction of a Z axis direction drive control section corresponding to the Z axis direction driving mechanism 23 described previously as well as the spray gun head unit and in that an instrument for measuring a Z axis displacement distance is used. Construction of the other major part such as the X and Y axis direction driving mechanism, etc. is almost identical to those used in the prior art automatic painting device.

Figure 1:
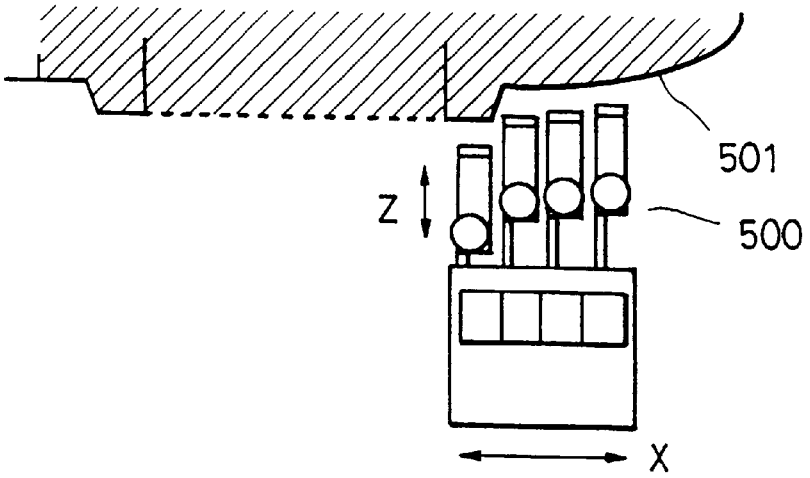
FIG. 1 is a diagram for explaining a relation between spray gun heads and a surface of a body to be painted.

In a case where e.g. a body 501 of an automobile is painted by means of an automatic painting device having (four) spray gun heads of four colors, as indicated in FIG. 1, it has been already described that it is necessary to move a spray gun head unit 500 in the X and the Y axis direction while keeping the distance in the Z axis direction from a curved surface of the body always constant, to print. X and Y axis direction driving signals for the spray gun heads are obtained easily by processing original image data and on the other hand Z axis direction driving signals are obtained by calculation, starting from the measured data and the set data.

Figure 2:
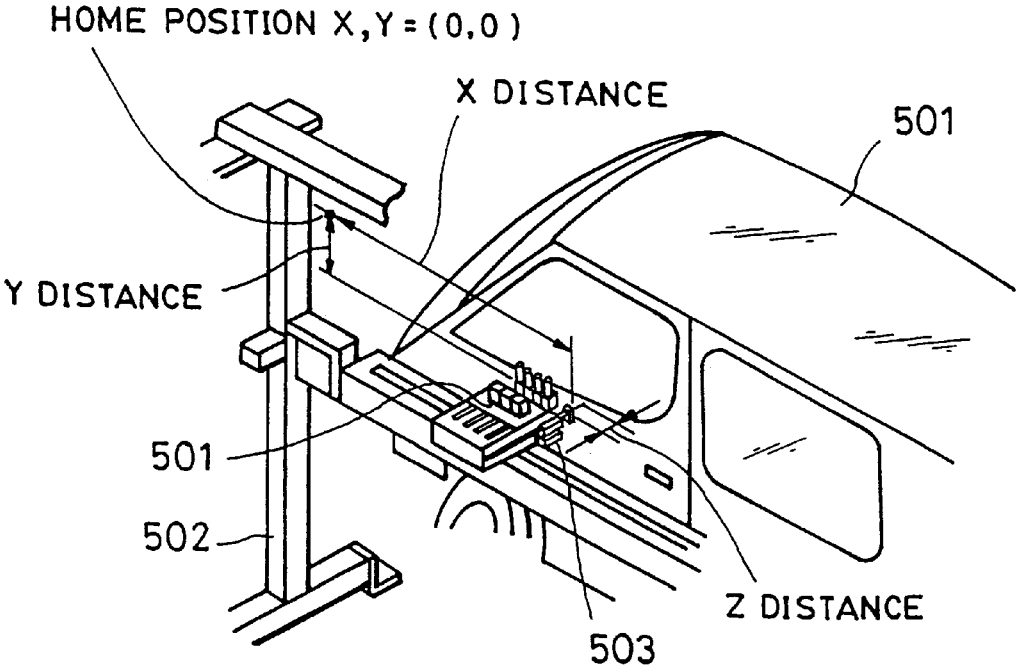
FIG. 2 is a diagram for explaining a method for measuring body data.
Figure 3:
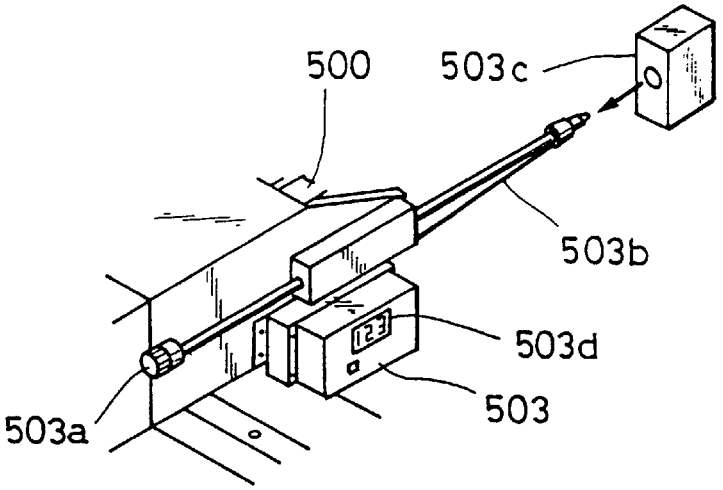
FIG. 3 is a perspective view showing a body data measuring instrument.
Figure 4:
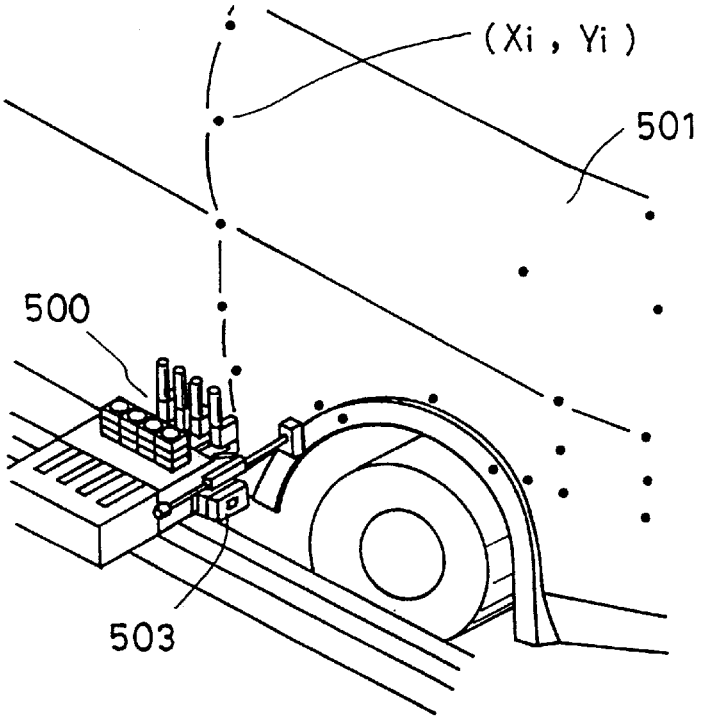
FIG. 4 is another diagram for explaining the method for measuring body data.

FIGS. 2 to 4 show an example of the method for measuring the Z axis direction displacement distance (body data) in the present invention. In FIG. 2, 502 is a frame member supporting the X, Y, Z axis direction displacement mechanisms for the spray gun head unit 500 and 503 is a body measuring instrument for measuring the Z axis direction displacement distance, which is mounted on the right side surface of the spray gun head unit 500.

The body measuring instrument 503 has a bar-shaved marker 503*b,* which is moved in the Z axis direction by rotating a knob 503*a,* as indicated in FIG. 3. A measurement plate 503*c* is mounted at the extremity thereof. The measurement plate 503*c* has a shape analogous to that of the spray gun head unit 500.

When the marker 503*b* is moved by rotating the knob 503*a* to bring the measuring plate 503*c* into contact therewith, as indicated in FIG. 4, the Z axis direction displacement distance Z; is measured and a measured value thereof is displayed on a display section 503*d.* At the same time it is transmitted to a Z axis direction drive control section described later. This process is repeated successively for a plurality of coordinate points (Xi, Yi) e.g. on a surface to be painted of a body 501 of an automobile.

As described above, at measuring the Z axis direction displacement distance, by using the measurement plate 503*c,* at the same time as the measurement of Zi, it is possible to judge beforehand the possibility of the displacement or driving of the spray gun heads in the Z axis direction with respect to the measurement points.

Figure 5:
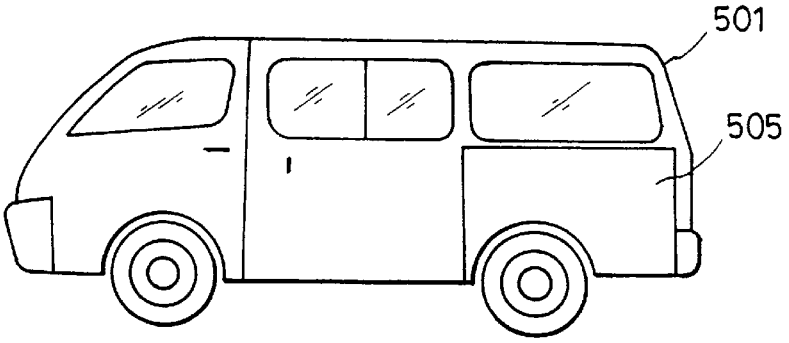
FIG. 5 is a diagram showing an example of a region to be painted of a body of an automobile.
Figure 6:
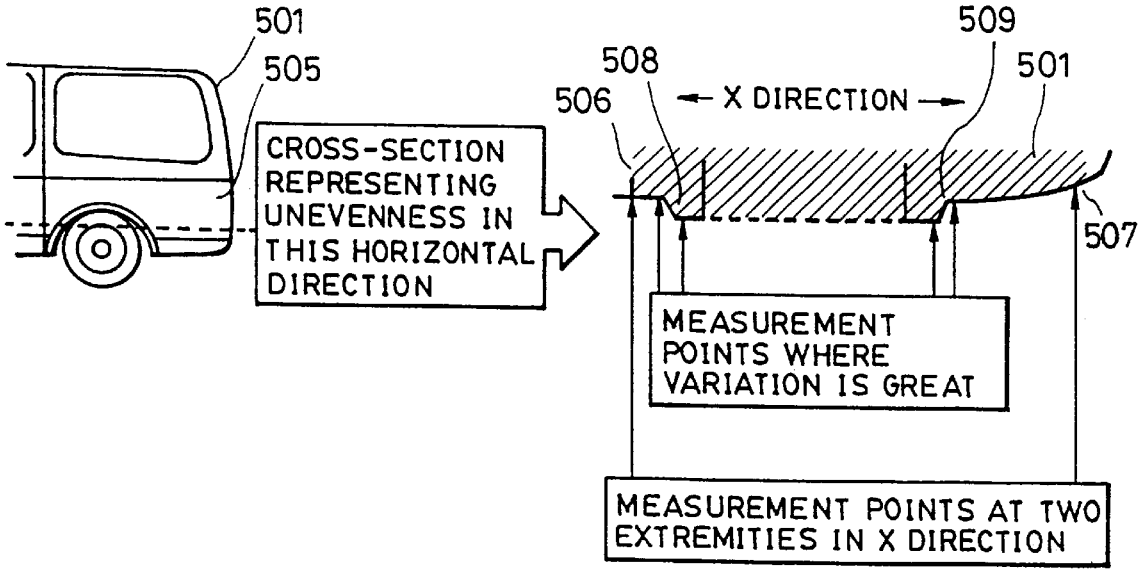
FIG. 6 is a diagram for explaining a method for determining points to be measured.

Coordinate points (measurement points) to be measured are determined, depending on the shape of the body in a region to be painted 505, as indicated in FIG. 5. The principle, according to which the measurement points are determined, is as follows. For example, as indicated in FIG. 6, (i) the two extremities 506 and 507 of the region to be painted 505 in the X axis direction are forced measurement points, and (ii) positions 508 and 509, where variations in the X and the Y axis direction are great, are forced measurement points.

Figure 7:
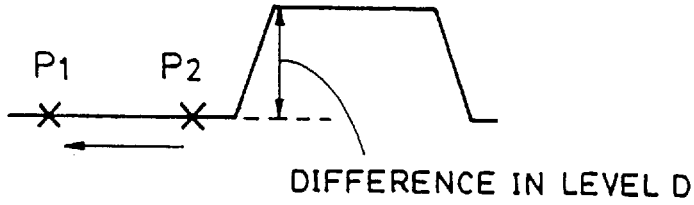
FIG. 7 is a diagram showing a relation between a difference in level in a Z axis direction and an interval between points to be measured.
Figure 8:
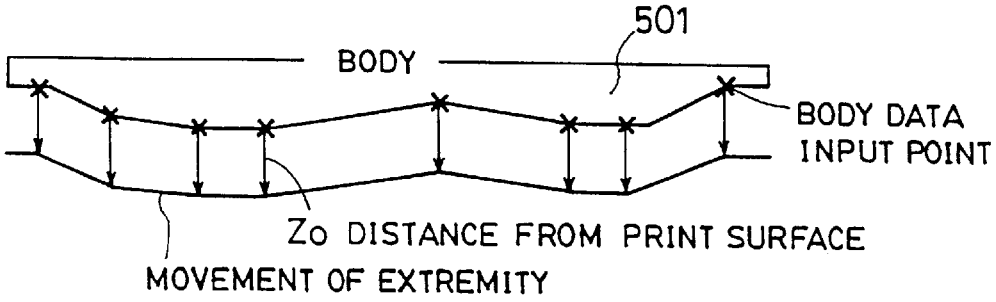
FIG. 8 is a diagram showing distances from the surface to be painted.

Further, particularly as indicated in FIG. 7, when a protrusion D exists on the surface to be painted and a difference in level Z is great, measurement points $P_1$, $P_2$ are selected so as to be relatively far separated therefrom so that the displacement in the Z axis direction is possible.

Further a desired distance Zo from the surface to be painted in the Z axis direction is set together with a desired painting speed. This is a distance in the Z axis direction between the extremity of the spray gun head unit and the surface to be painted. A displacement of Zi-Zo in the Z axis direction may be effected by setting with which distance from the surface to be painted the painting should be effected.

Figure 9:
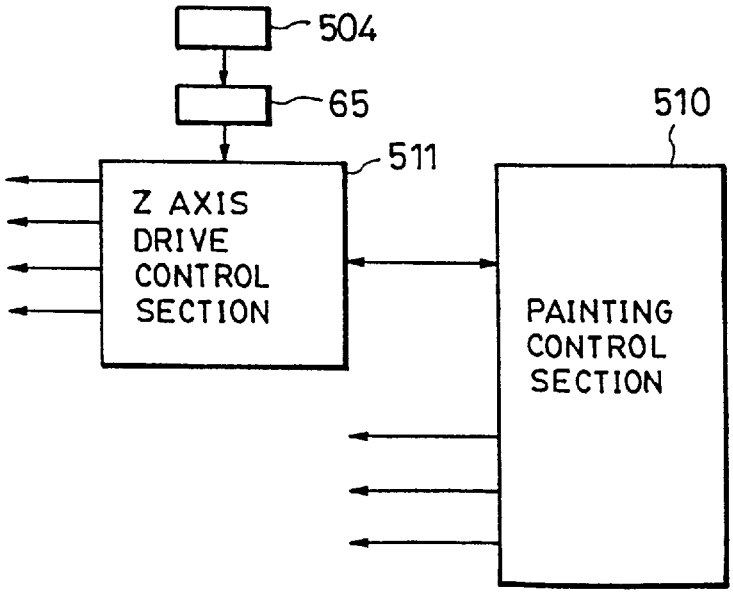
FIG. 9 is a block diagram showing an embodiment of the present invention.

The control device used in the present embodiment comprises a painting control section 510 corresponding to the X, Y axis direction driving mechanism and a Z axis direction drive control section 511 corresponding to the Z axis direction driving mechanism, as indicated in FIG. 9. The painting control section 510 drives the different driving mechanisms and motors for driving them according to shape data of the surface to be painted and mounting position data of the spray gun heads 504. In this way the spray gun head unit 500 is driven in the X and the Y axis direction so that one of the spray gun heads 504 is located at a position opposite to a certain point to be painted. Painting is effected by driving the four spray gun heads 504 independently from each other so as to eject paints or inks. Further the Z axis direction drive control section 511 receives the measured data and the set data coming from input means (body measuring instrument) 503 and controls stepping motors driving the different spray gun heads, depending on the distances from the surface to be painted, to determine positions in the Z axis direction of the different spray gun heads 504.

Figure 10:
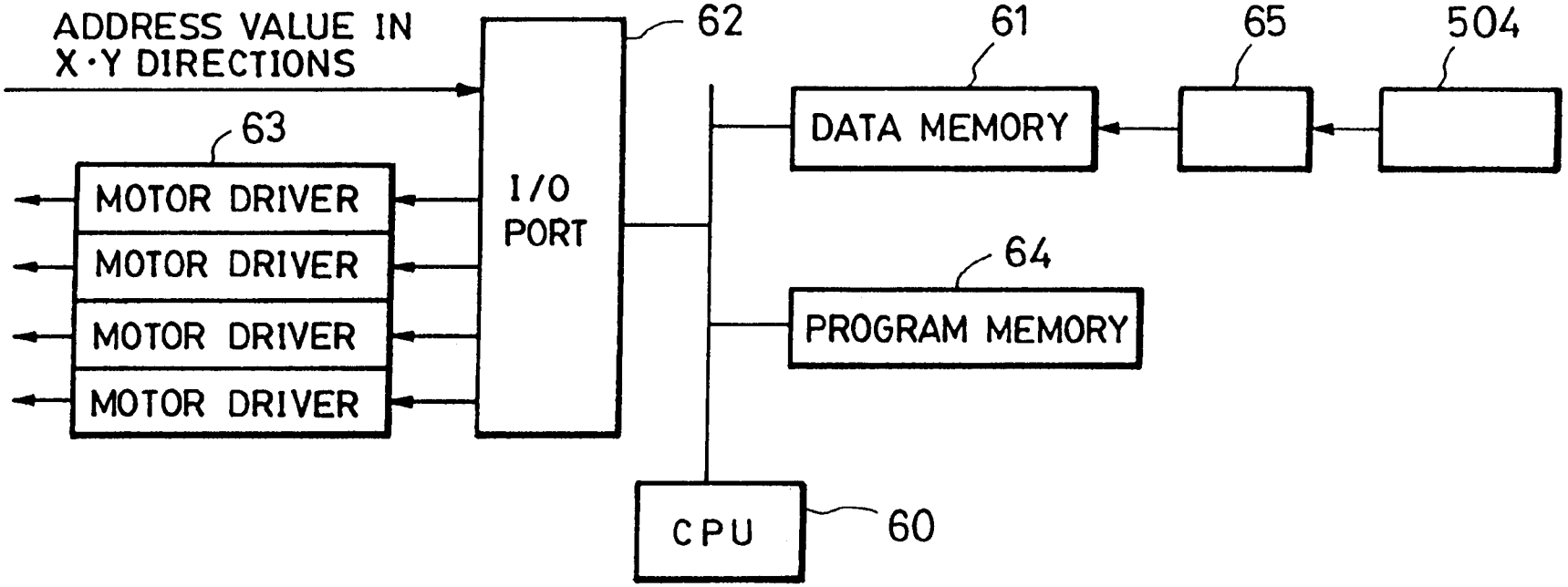
FIG. 10 is a block diagram showing a principal part of the embodiment.

FIG. 10 shows the construction of the Z axis direction drive control section 511. At first, positions of one of the spray gun heads 504 in the X and the Y axis direction are determined. This determination may be effected manually or data previously stored in a memory may be used therefor. The driving mechanisms and the motors for driving them are driven on the basis of these position data to determine the positions in the X and the Y axis direction of the respective spray gun head 504. When the set value Zo and the measured value Zi of the Z axis direction displacement distance is inputted from the input means 503, a judging section 65 compares Zi with the Z axis direction drive capacity data, and when it is judged that the spray gun head unit can be driven, Zi is stored in a data memory 61 together with Zo. The Z axis direction drive capacity data is determined in order to prevent damage of the spray gun heads during displacement thereof and set previously, depending on the shape of the surface to be painted, etc. A CPU 60 compares address values (position data) in the X and the Y axis directions with the data stored in a data memory 61 and controls drivers 63 for the stepping motors in the X, the Y and the Z axis drive directions through an I/O port 62 so that the set values and the measured values coming from the input means 503 are approximately equal to the data stored in the data memory 61 and that the spray gun heads 504 are moved in the Z axis direction to determine the position thereof. At that position color ink is ejected from one of the spray gun heads 504 so that the point is painted in one of the three primary colors or black. The point on the surface to be painted is painted in a predetermined color tone by repeating this control for the other three spray gun heads 504.

In case where CAD data, teaching data, etc. are used, these data can be utilized if necessary by inputting previously these data to a program memory 64. As described above, by using the automatic painting device according to the present embodiment, since displacements in the Z axis direction of the different spray gun heads 504 are controlled independently from each other, it is possible to control the spray gun heads 504 so that the distances between the surface to be painted and them are kept constant, even if the surface to be painted has a complicated curved shape and therefore to paint clearly in a predetermined color tone.

Figure 11:
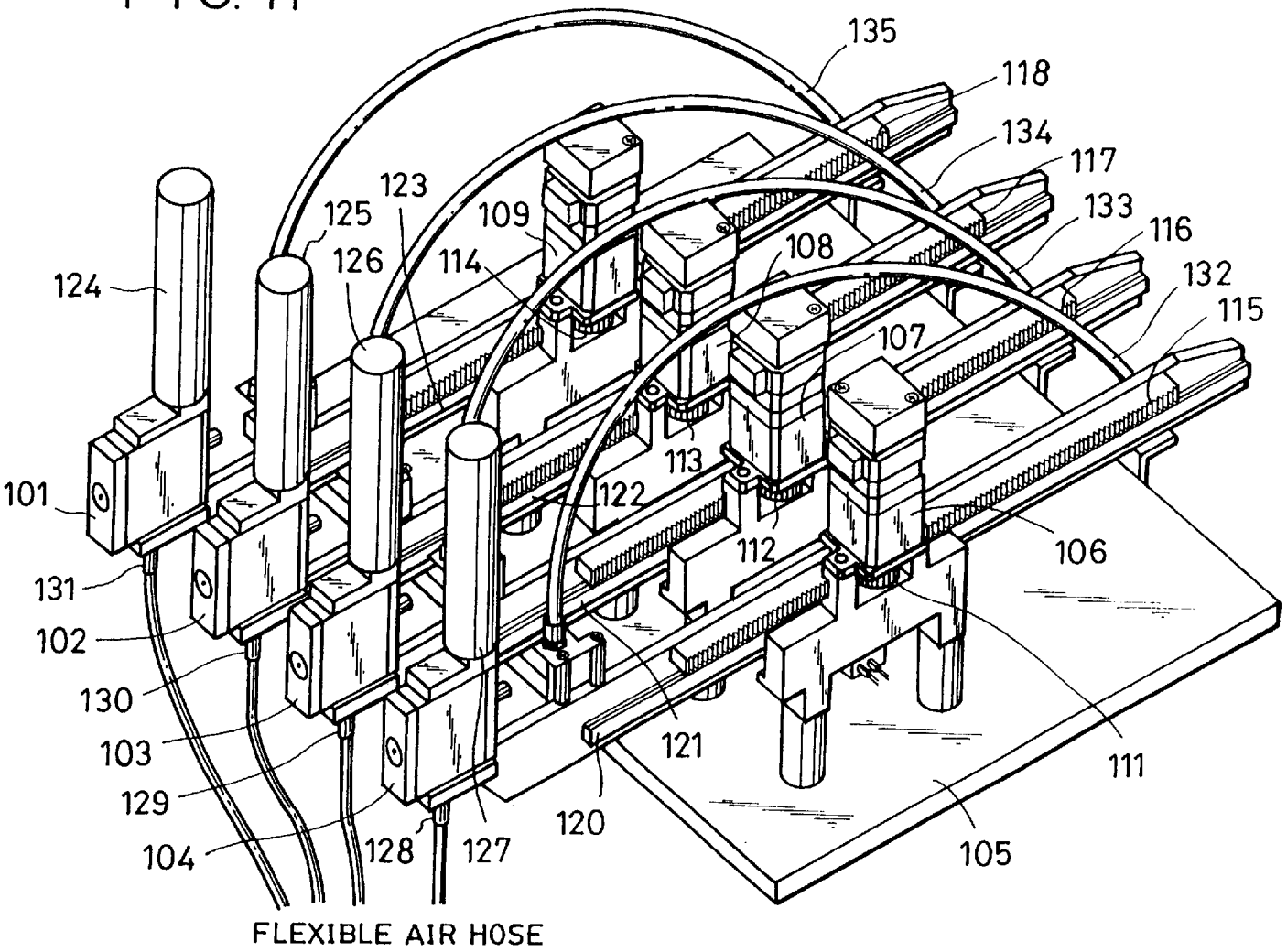
FIG. 11 is a perspective view showing a spray gun head unit used in a device according to the present invention.
Figure 12:
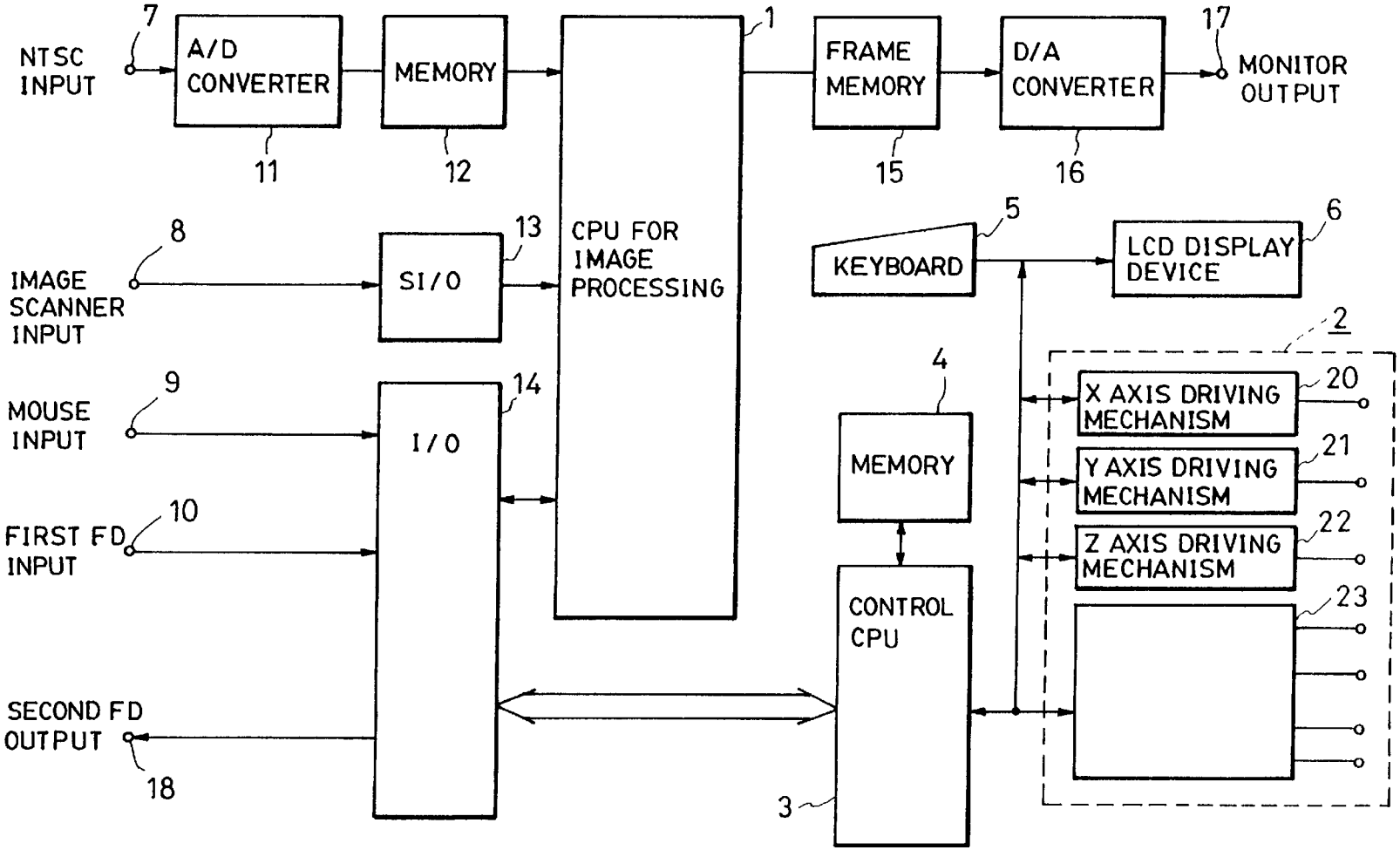
FIG. 12 PRIOR ART
FIG. 12 is a block diagram showing an example of a prior art automatic painting device.
Figure 13:
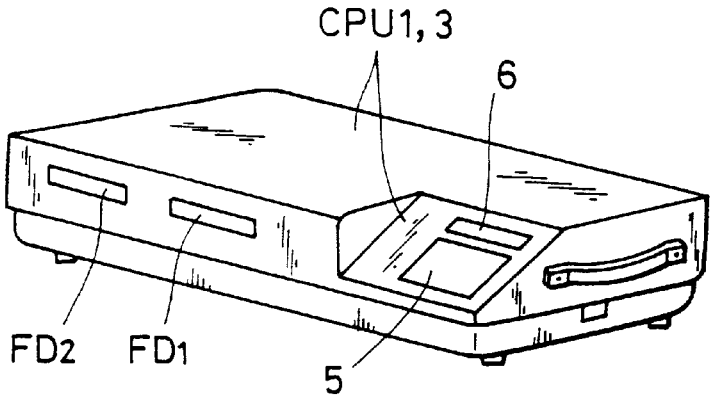
FIG. 13 PRIOR ART
FIG. 13 is a perspective view showing a prior art CPU used in the device indicated in FIG. 12.
Figure 14:
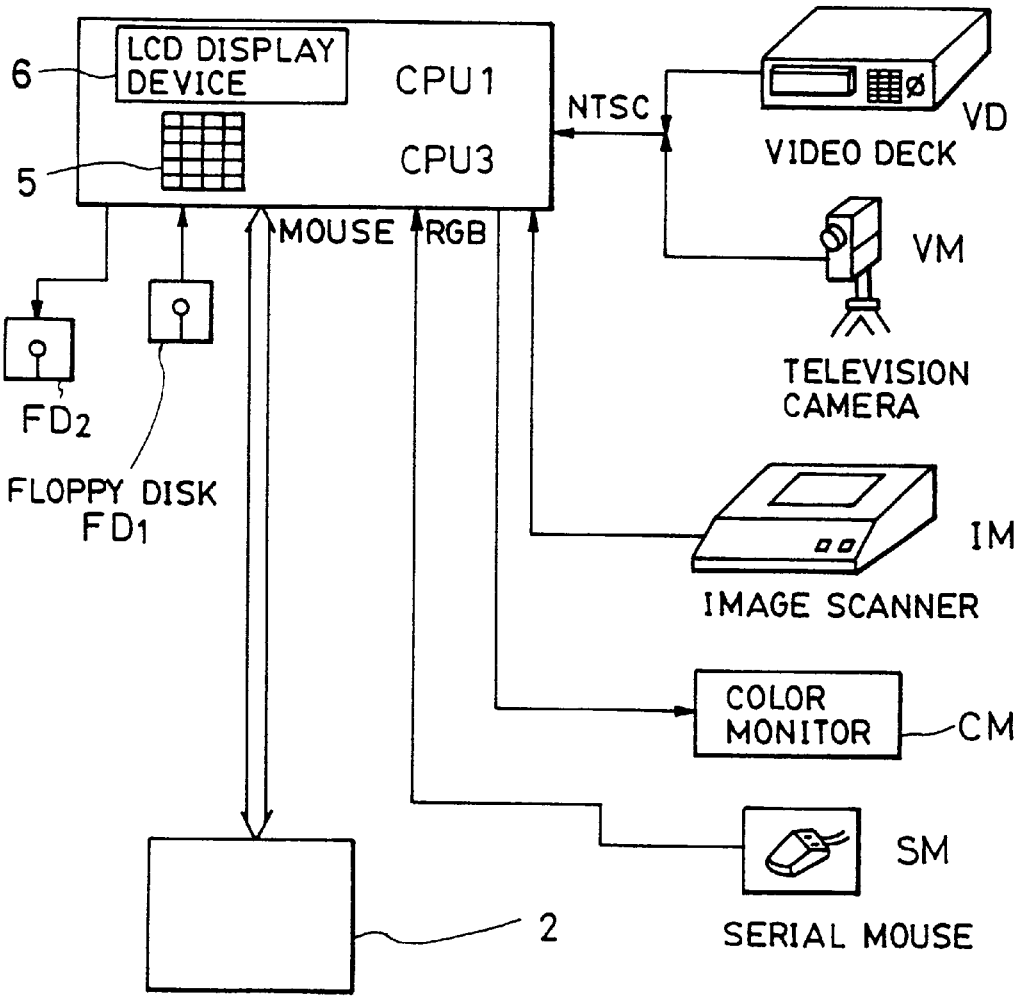
FIG. 14 PRIOR ART
FIG. 14 is a block diagram showing a principal part of the prior art device indicated in FIG. 12.
Figure 15:
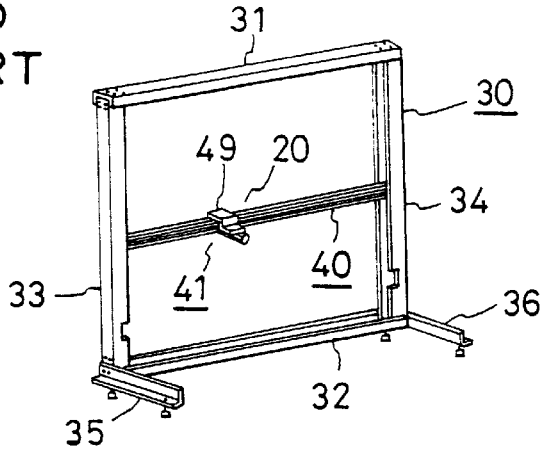
FIG. 15 PRIOR ART
FIG. 15 is a perspective view showing a prior art frame used in the device indicated in FIG. 12.
Figure 16:
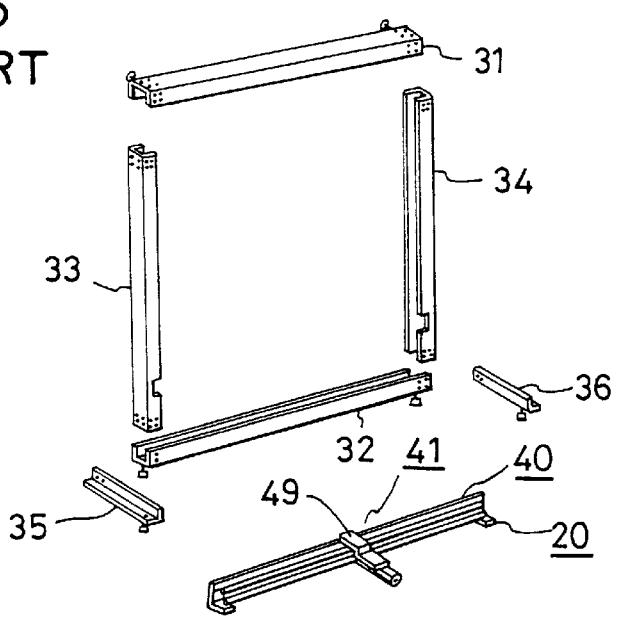
FIG. 16 PRIOR ART
FIG. 16 is an exploded perspective view of the prior art frame.
Figure 17:
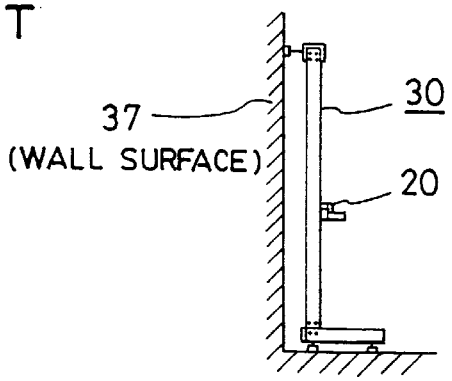
FIG. 17 PRIOR ART
FIG. 17 is a side view of the frame.
Figure 18:
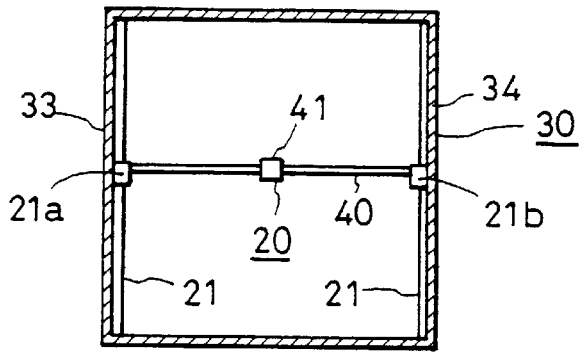
FIG. 18 PRIOR ART
FIG. 18 is a cross-sectional view of the prior art frame.
Figure 19:
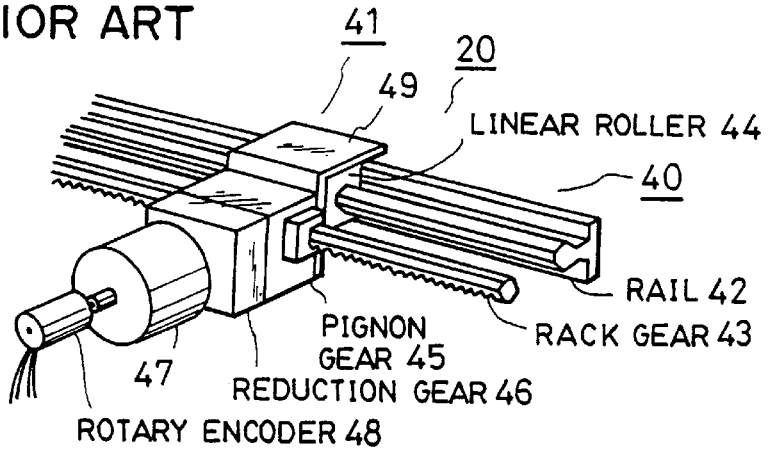
FIG. 19 PRIOR ART
FIG. 19 is a perspective view showing an X and Y axis prior art driving mechanism mounted on the frame.
Figure 20:
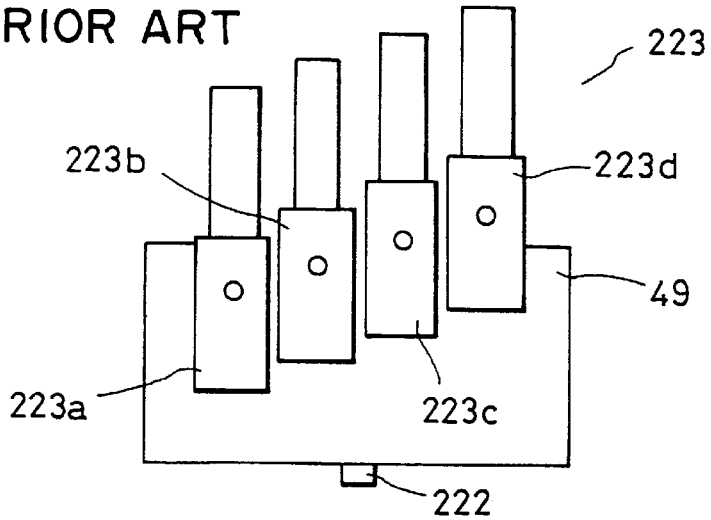
FIG. 20 PRIOR ART
FIG. 20 is a diagram showing an outline of the prior art spray gun head unit.
Figure 21:
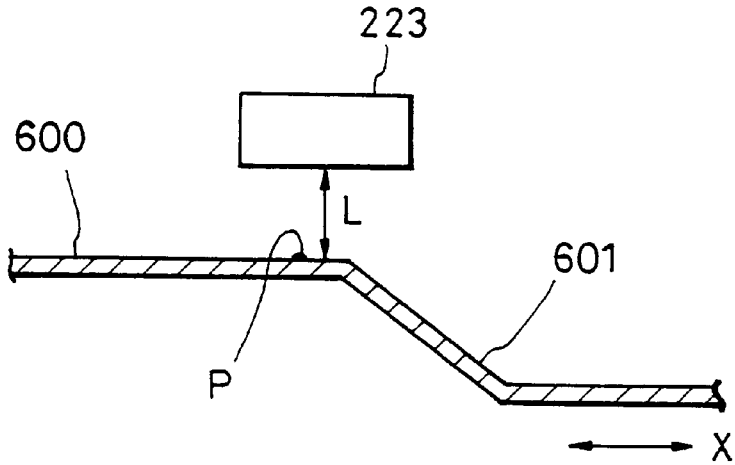
FIG. 21 PRIOR ART
FIG. 21 is a diagram showing a relation in an X axis direction between the prior art spray gun head unit and a surface to be painted.
Figure 22:
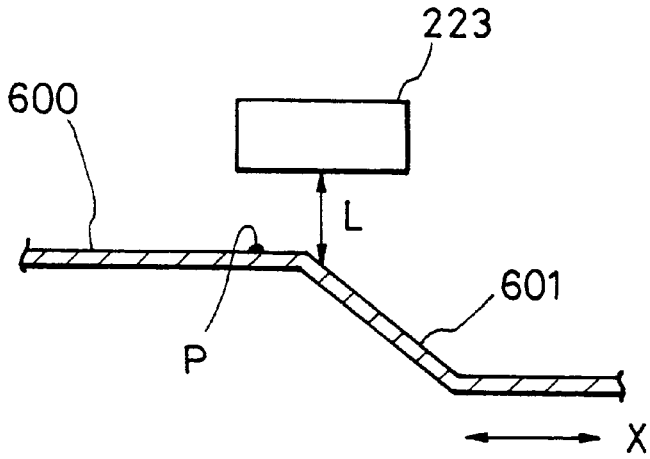
FIG. 22 PRIOR ART
FIG. 22 is a diagram showing another relation in the X axis direction between the prior art spray gun head unit and the surface to be painted.
Figure 23:
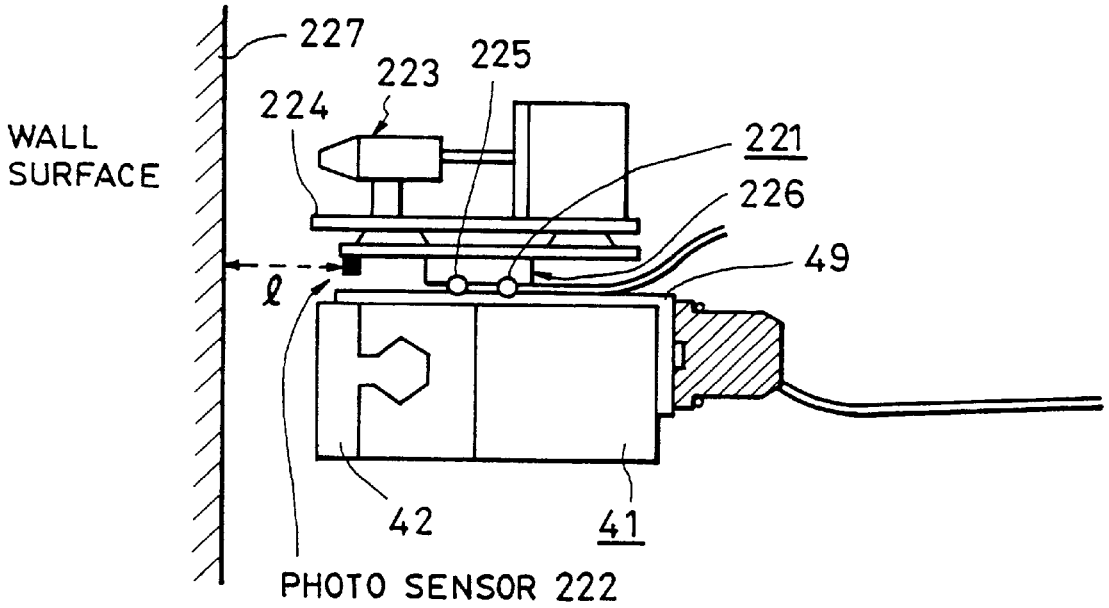
FIG. 23 PRIOR ART
FIG. 23 is an illustration of an example of a prior art automatic painting device.

FIG. 11 shows an example of the construction of the spray gun head unit used in the device according to the present invention, in which 101 to 104 are spray gun heads, which are supported movably in the Z axis direction on a base plate 105 by driving motors 106 to 109, pignon gears 111 to 114, rack gears 115 to 118 and slide rails 120 to 123. As described above, this unit itself is mounted movably in addition in the X and the Y axis direction on the frame member 502.

124 to 127 are nozzles for the different color inks of Y, M, C and K. These nozzles may be disposed separately from the spray gun heads, which are fed through flexible ink pipes. 128 to 131 are inlets for taking-in air pressure fed through flexible hoses.

Further 132 to 135 are flexible signal cables for the different spray gun heads.

It is preferable that the air hoses, the signal cables, etc. are disposed, accommodated e.g. in a flexible cable caterpillar.

As explained above, by using an automatic painting device according to the present invention, it is possible to paint clearly in a predetermined color tone on a surface to be painted having a complicated curved shape such as a body, a bumper of an automobile, etc.

Although a particular preferred embodiment of the invention has been disclosed in detail for illustrative purposes, it will be recognized that variations or modifications of the disclosed apparatus, including the rearrangement of parts, lie within the scope of the present invitation.

What is claimed is:

1. An automatic painting device comprising:

holding means for holding a plurality of air pressure ejection type color ink spray gun heads movable in X, Y and Z axis directions;

X and Y axis direction driving means for driving said holding means in the X and Y axis directions parallel to a surface to be painted;

Z axis direction driving means for driving said spray gun heads independently from each other in the Z axis direction perpendicular to the surface;

control means, which controls driving of said spray gun heads and amounts of color paints ejected, depending on a position and a color tone of each pixel of an original image;

measuring means for measuring displacement distances in the Z axis direction from said spray gun heads to a plurality of coordinate points in a desired region on the surface to be painted to output measured data;

setting means for setting desired painting speeds and desired painting distances in the Z axis direction from the surface to be painted to output set data; and input means for inputting the measured data and the set data to said control means, said control means comparing the measured data coming from said measuring means with Z axis direction driving capacity data and, when the control means judges from the comparison that said spray gun heads can be driven safely, controlling driving of said spray gun heads in the Z axis direction on the basis of the measured data and the set data.

2. An automatic painting device according to claim 1, wherein said measuring means includes a body measuring instrument, which measures said Z axis direction displacement distances from said spray gun heads to a coordinate point by bringing a marker into contact with said coordinate point, and a measuring plate having a shape analogous to said spray gun heads being mounted on an extremity of said marker.

3. An automatic painting device according to claim 1, wherein said measuring means includes a display for displaying the displacement distance in the Z axis direction and sets an interval between coordinate points in the X axis direction, depending on said painting speeds and distances, over which said spray gun heads are movable in the Z axis direction, corresponding to said coordinate points, to effect measurements for obtaining data on said coordinate points.

4. An automatic painting device according to claim 1, wherein said measuring means for measuring the displacement distance from said spray gun heads to the surface to be painted is mounted to said holding means adjacent said spray gun heads.

5. An automatic painting device according to claim 1, wherein said Z axis direction driving means comprises an individual drive motor for each respective said spray gun head, each of said individual drive motors capable of moving the respective said spray gun head independently from adjacent spray gun heads.

6. An automatic painting device according to claim 1, wherein said spray gun heads are aligned in a row on said holding means, each of said spray gun heads ejecting a different color of the paint.

7. An automatic painting device according to claim 1, wherein a stationary frame member supports said X and Y axis direction driving means and said holding means.

8. An automatic painting device comprising:

support means for supporting a plurality of air pressure ejection type spray gun heads movable in X and Y directions;

X and Y axis direction driving means for driving said support means in the X and Y axis directions, the X and Y axis directions defining a plane substantially parallel to a surface to be painted;

Z axis direction driving means for driving said spray gun heads independently from each other in the Z axis direction perpendicular to the surface to be painted;

control means for controlling the driving means and amounts of paint applied;

measuring means for measuring displacement distances in the Z axis direction from said spray gun heads to a plurality of coordinate points on the surface to be painted and for outputting measured data; and setting means for setting desired painting speeds and painting distances in the Z axis direction from the surface to be painted as output set data, wherein said control means compares the measured data with Z axis direction driving capacity data to ensure safe driving of said spray gun heads in the Z axis direction and, if safe operation is indicated, controlling driving of said spray gun heads in the Z axis direction on the basis of the measured data and the set data.

9. An automatic painting device according to claim 8, wherein said spray gun heads are aligned in a row on said support means, each of said spray gun heads ejecting a different color paint in a selected amount to form a color tone.

10. An automatic painting device according to claim 8, wherein said Z axis direction driving means comprises an individual drive motor for each respective said spray gun head.

11. An automatic painting device according to claim 8, wherein said measuring means for measuring the displacement distance from said spray gun heads to the surface to be painted is mounted to said support means adjacent said spray gun heads.

12. An automatic painting device according to claim 8, wherein each of said plurality of spray gun heads includes a different color paint.

13. An automatic painting device comprising:

a spray gun head unit supporting a plurality of air pressure ejection type spray gun heads;

X and Y axis direction driving means for driving said spray gun head unit in the X and Y axis directions, the X and Y axis directions defining a plane substantially parallel to a surface to be painted;

a plurality of Z axis direction driving motors mounted on said spray gun head unit and corresponding to each of said spray gun heads for driving said spray gun heads independently from each other in the z axis direction substantially perpendicular to the surface to be painted;

control means for controlling the driving means and amounts of paint applied by said spray gun heads depending on a position and a color tone of each pixel of an original image;

measuring means supported on said spray gun head unit for measuring displacement distances in the Z axis direction from said spray gun heads to the surface to be painted for a plurality of coordinate points and outputting measured data; and setting means for setting desired painting speeds and painting distances in the Z axis direction from the surface to be painted as output set data, wherein said control means compares the measured data with Z axis direction driving capacity data to ensure safe driving of said spray gun heads in the Z axis direction and, if safe operation is indicated, controlling driving of said spray gun heads in the Z axis direction on the basis of the measured data and the set data.

14. An automatic painting device according to claim 13, wherein said spray gun heads are aligned in a row on said spray gun head unit, each of said spray gun heads ejecting a different color paint.

15. An automatic painting device according to claim 13, wherein said support means comprises a stationary frame member supporting said X and Y axis direction driving means and said spray gun head unit.

16. An automatic painting device according to claim 13, wherein said measuring means includes a display for displaying the displacement distances in the Z axis direction.

* * * * *